United States Patent [19]

Seidinger

[11] Patent Number: 4,995,541

[45] Date of Patent: Feb. 26, 1991

[54] SET OF GUIDE ROLLS FOR GUIDING, POSITIONING AND CONTROLLING MOTION OF BANDS OF MATERIAL FED THROUGH THE ROLLS

[75] Inventor: Gottfried Seidinger, Graz, Austria

[73] Assignee: Maschinenfabrik Andritz Actiengesellschaft, Graz, Austria

[21] Appl. No.: 389,358

[22] Filed: Aug. 3, 1989

[30] Foreign Application Priority Data

Aug. 4, 1988 [AT] Austria ..... 1969/88

[51] Int. Cl.[5] ..... B65H 23/26

[52] U.S. Cl. ..... 226/174; 226/199; 226/180; 72/160

[58] Field of Search ..... 72/164, 165, 160, 162, 72/205; 226/189, 190, 179, 180, 174, 199

[56] References Cited

U.S. PATENT DOCUMENTS

| | | | |
|---|---|---|---|
| 2,635,872 | 4/1953 | Birse | 226/189 |
| 2,821,387 | 1/1958 | Faeber | 226/180 |
| 3,249,276 | 5/1966 | Bergen | 226/174 |
| 3,327,509 | 6/1967 | Roesch | 72/164 |
| 4,179,913 | 12/1979 | Martt | 226/21 |
| 4,635,458 | 1/1987 | Bradlee | 72/165 |

FOREIGN PATENT DOCUMENTS

| | | | |
|---|---|---|---|
| 1156133 | 11/1983 | Canada | 72/164 |
| 1452203 | 5/1969 | Fed. Rep. of Germany . | |
| 2158163 | 6/1973 | France | 72/165 |
| 2550973 | 3/1985 | France | 72/164 |
| 2595339 | 3/1987 | France . | |
| 42756 | 3/1980 | Japan . | |
| 139230 | 10/1981 | Japan | 72/165 |
| 76621 | 5/1984 | Japan | 72/164 |
| 966572 | 8/1964 | United Kingdom | 226/189 |

*Primary Examiner*—Daniel O. Crane
*Attorney, Agent, or Firm*—Paul & Paul

[57] ABSTRACT

The invention relates to a process for the guiding, positioning and motion control of bands of material and a set of guide rolls for carrying out the invention. A pivotal frame rotatable and pivotal about an imaginary vertical axis with regard to a stationary basic frame by means of a pivotal cylinder is supported on said stationary basic frame. On the pivotal frame, two lower rolls with horizontal axes are spacially supported. An upper roll with horizontal axis rotatably supported on a superposed frame is descendable into said space. The superposed frame is articulated to the pivotal frame on one end by means of uprights and on the other end by means of contact pressure cylinders. It is the object of the invention to use said set of guide rolls also as a set of driving or braking rolls in order to achieve an effective guidance and control of the band also during the entrance and exiting stage. This is achieved by forming the uprights as double-armed levers pivotal by means of pivotal cylinders in their centers about a horizontal axis arranged on the pivotal frame.

3 Claims, 4 Drawing Sheets

SET OF GUIDE ROLLS FOR GUIDING, POSITIONING AND CONTROLLING MOTION OF BANDS OF MATERIAL FED THROUGH THE ROLLS

The present invention relates to a process for the guidance, positioning and motion control of bands of material, in particular metal bands or strips such as steel bands, transversely to and in band advance direction, in particular for the guidance, positioning and motion control of the center or the edges of the band, as well as a set of guide rolls for carrying out this process in which a pivotal frame rotatable about an imaginary vertical axis is supported on a stationary basic frame preferably by means of slide tracks, a control cylinder connected to the basic frame as well as to the pivotal frame being provided for the guiding motion of the band transversely to the band advance direction, on which pivotal frame two spacially arranged lower rolls with horizontal axes are rotatably supported and a third, upper roll for the guiding operation from above and descendable from above into said space is rotatably supported on a superposed frame whose one end viewed in band avance direction is articulated to the upper end of uprights connected to the pivotal frame and whose other end is also articulated to the pivotal frame via pressure cylinders.

In a known process and device of this type, the pivotal frame supporting the three rolls is pivoted by mean of adjusting lever and control cylinder, which is normally a double-action cylinder, around a central point coinciding with the middle of the incoming band. A band of material can be a metal band or strip, for instance a steel band, which is guided in controlling the band center or band edges through for instance the side-cut shears of an advance pickling bath, various other band treatment apparatus or transverse and longitudinal cutting apparatus and rolling mills. In the operational stage, the upper roll presses by means of the pressure cylinder the tensioned material below the upper tangent of the two lower rolls on the pivotal frame and thus creates contact areas on the rolls, so that lateral guiding forces can be transmitted to the band by means of the control cylinder and the pivotal frame.

This known process and device call for a separately disposed socalled driver which is not arranged on the frame bearing the set of guide rolls for the band guidance transversely to the band advance direction. This driver is a driven and brakable pair of rolls as a pressing site which assures the tensioning of the band of material on entering (i.e. at the band start) and exiting (i.e. at the band end).

It is the object of the present invention to provide a process and a set of guide rolls in which the function of the driver or the brake (negative driver) and the function of the band guidance are combined. This eliminates the previously mentioned, separately disposed driver element and results in a considerable saving in material investment and space.

This object is achieved according to the invention in a process as initially described by providing for the guidance, positioning and motion control transversely to the band advance direction as well as the guidance, positioning and motion control in band advance direction, in the driving or braking operation, to be performed by means of a single set of control cylinders. The set of control cylinders initially mentioned is characterized according to the invention in that for changing from guiding operation to driving or braking operation or vice versa, the uprights are formed as double-armed levers which are pivotal approximately in their central area about a horizontal axis arranged on the pivotal frame and that a pivotal cylinder whose other end is articulated to the pivotal frame is articulated to each lower end of said double-armed levers. It has proven as particularly convenient if the third, upper roll is suited for being moved into a position above the frontmost lower roll and for being pressed against it in the driving or braking operation.

A further embodiment of the invention is characterized in that the pivotal cylinder and the contact pressure cylinder are controlled by a common control means so that the upper roll can be made to pass along a predeterminable motion line or track when switching from the driving and braking operation to the guiding operation and vice versa This has the advantage that in the transitional phase between driving or braking operation and guiding operation, and vice versa, the band is continuously kept under control and guidance in any given position and at any time.

It is convenient if at least in driving or braking operation, the frontmost lower roll viewed in band advance direction is made drivable and/or brakable. But it is also possible to provide for the third, upper roll to be drivable and/or brakable at least in driving or braking operation. Conveniently, the upper roll and the frontmost lower roll viewed in band advance direction can have a braking effect on the band in guiding operation, as well.

The set of guide rolls according to the invention can thus be used in the entrance stage of the band, i.e. at its start, as a guiding driver, i.e. the start end of the band can be advanced by driver function of the set of guide rolls guided in respect of the band center and band edges, and in the exiting stage of the band as a set of guiding brake rolls, i.e. the band end can be tensioned with guidance of the band center and band edges by countertraction function of the set of guide rolls (so-called negative driver function). Between these two stages, i.e. in the operational stage and the main or guiding operation, the set of guide rolls according to the invention operates as a normal band guidance. The guidance and control of a band is thus maintained during its entire handling, i.e. entering, operational and exiting stage.

The invention is explained in the following by means of exemplary embodiments under reference to the drawings.

Figure 1B:
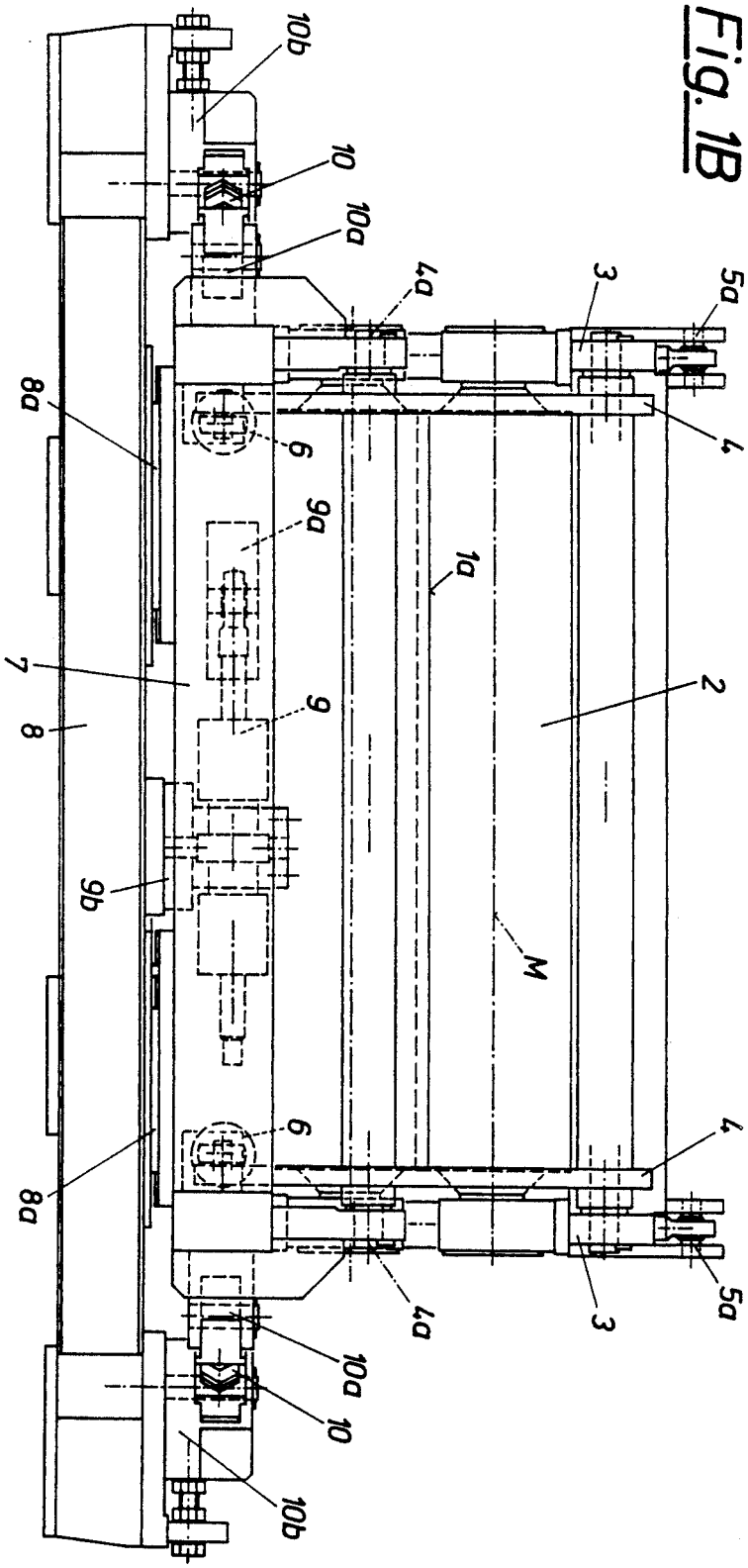
FIG. 1B represents a view of the set of guide rolls according to the invention viewed counter to the band advance direction.
Figure 1A:
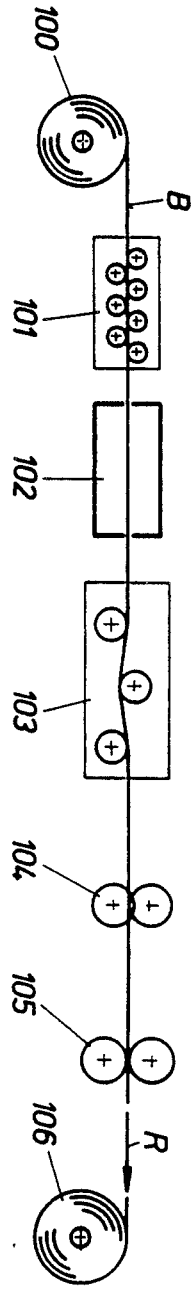
FIG. 1A shows a diagrammatic representation of the state of the art.
Figure 2:
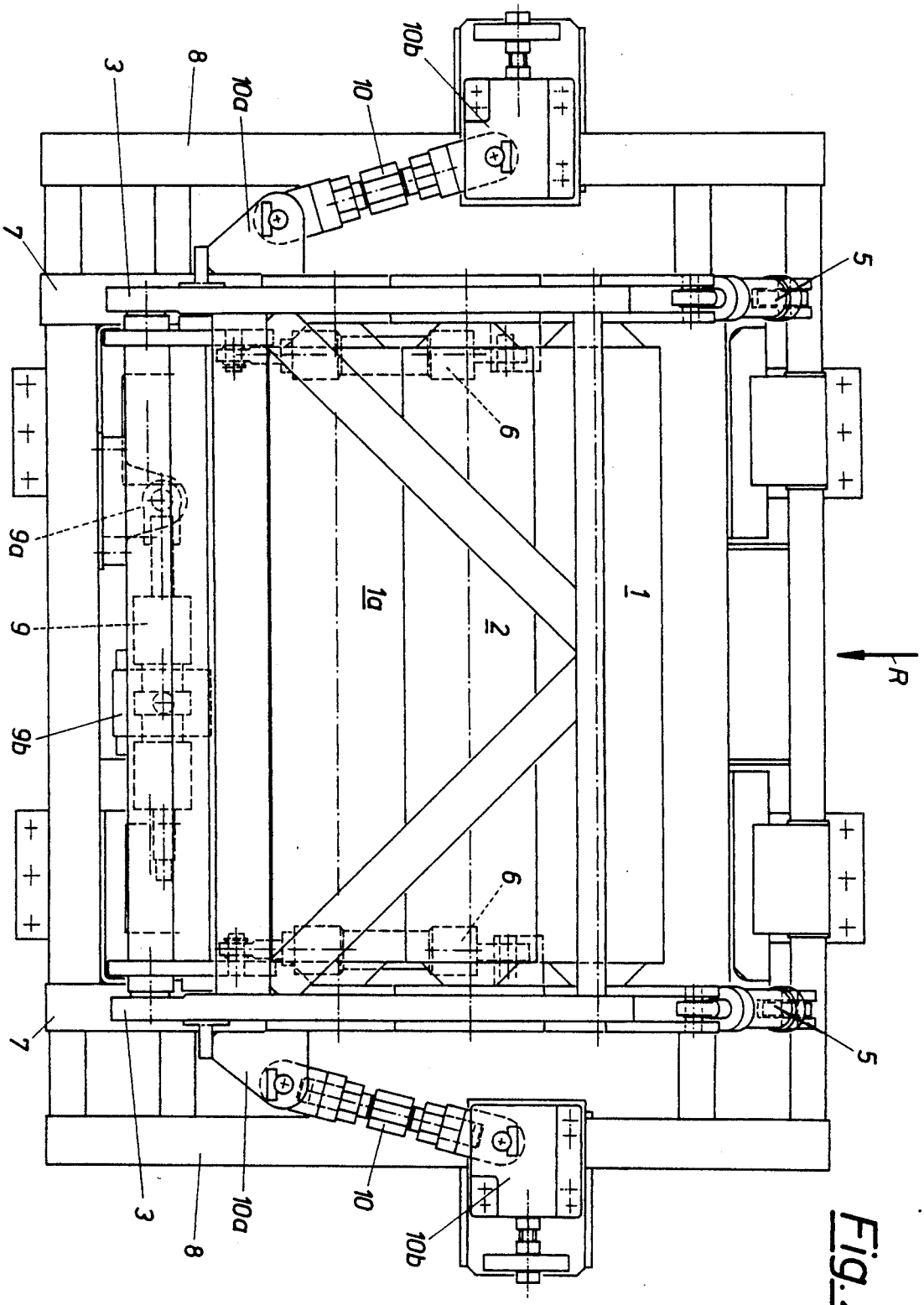
FIG. 2 shows the respective elevational view.

According to FIG. 1A, which shows a known process purely for illustrative purposes, the band B is wound off an unwinding reel 100, passes a straightening machine 101, then a pickle bath or a spray pickling solution 102, then a set or guide rolls 3 comprising three rolls which in the known case merely serves for guiding the band transversely to the band advance direction R, then side-cut shears 104 and is then kept tensioned by a driver 105 comprising two driven or braked rolls in order to be wound up subsequently on the winding-up reel 106.

In the embodiment of the invention according to FIG. 1B to 3A, a pivotal frame 7 rotatable on a sliding track or sliding ledge 8*a* about an imaginary vertical axis on a stationary basic frame 8 is provided. The rotating or pivoting motion of the pivotal frame 7 in respect of the basic frame in two opposing directions starting out form a basic position is caused by a hydraulically or pneumatically actuated control cylinder 9 (double-action cylinder) whose one end is articulated to a guiding support 9 being firmly connected to the pivotal frame 7 and whose other end is articulated to a guiding support 9*b* connected to the basic frame 8.

In addition, two longitudinally adjustable steering rods 10 for adjusting the basic position are provided between the basic frame 8 and the pivotal frame 7. The steering rods are articulated to the pivotal frame 7 via guiding support 10*a* and on the basic frame via guiding support 10*b*.

Two spacially arranged lower rolls 1, 1*a* are rotatably supported about horizontal axes on the pivotal frame 7. Two uprights formed as double-armed levers 4 are further articulated to the pivotal frame 7 and articulated on their upper ends at 4*b* to one end of a superposed frame 3; on the other end of the superposed frame 3, two hydraulically or pneumatically actuated contact pressure cylinders 5 are articulated at 5*a*, while their other ends are articulated to the pivotal frame 7 at 5*b*.

The superposed frame 3 carries a third, upper roll 2 rotatably supported about the horizontal axis or central line M; said roll 2 can be lowered by means of the contact pressure cylinder 5 from above into the space between the lower rolls 1 and 1*a*.

The articulation of the uprights formed as double-armed levers 4 on the pivotal frame is effected approximately in their central zone by means of the horizontal axis 4*a*. One each hydraulically or pneumatically actuated pivotal cylinder 6 whose other end is articulated to the pivotal frame 7 at 6*a* is articulated to the lower ends of said double-armed levers 4 at 6*b*.

Figure 3:
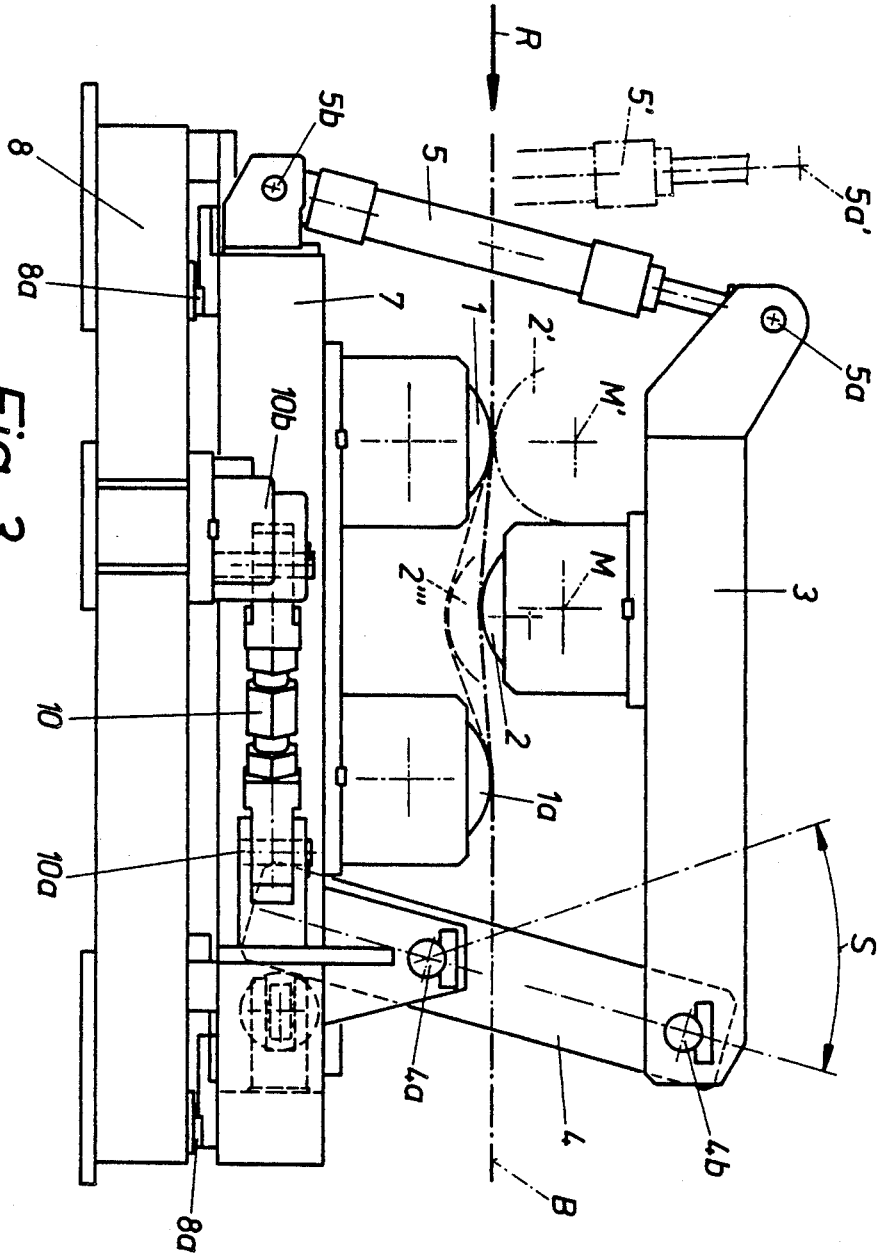
FIGS. 3 and 3A represent diagrammatic sketches of a possible transition of the rolls from driving or braking operation to main operation and FIG. 4 is an elevational view similar to that of FIG. 3 of a further embodiment of the invention, although the representation of the set of guide rolls is reversed in respect of the representation in FIG. 3.
Figure 3A:
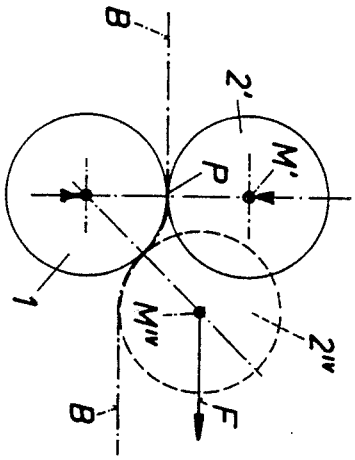
Figure 4:
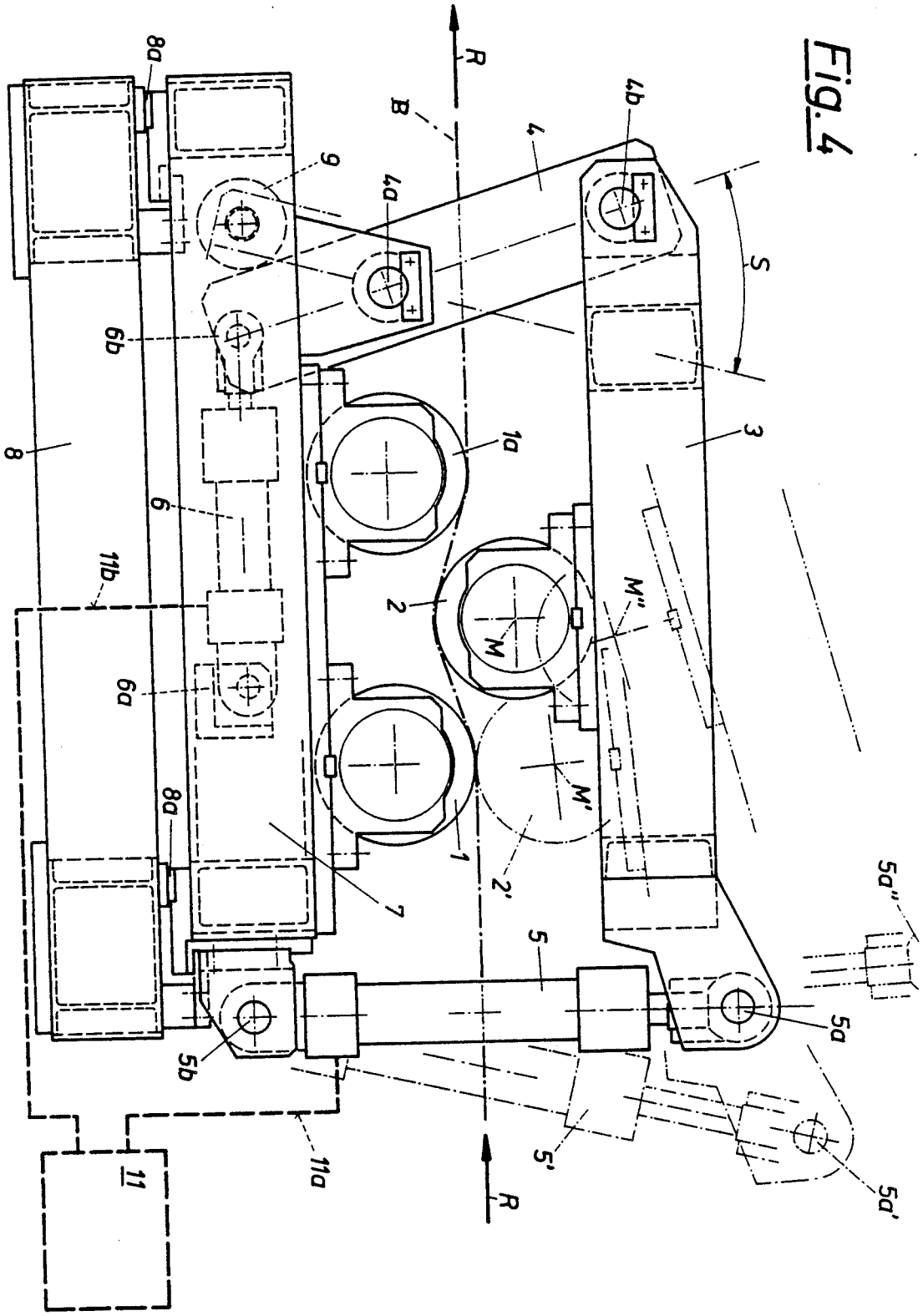

By means of the pivotal cylinder 6, the double-armed lever 4 and thus the superposed frame 3 is pivotal around the pivoting area bearing the reference symbol S in FIG. 3 and 4, whereby the upper roll 2 is placed in its position 2′ (center line M′) above roll 1 shown in FIGS. 3 and 3A. This also results in the position 5′ and 5*a*′ for the contact pressure cylinder 5 and its articulation point 5*a* as shown in FIGS. 3 and 4.

The symbol B is used for the material band, in particular the metal band, for instance a steel band, while R designates the band advance direction.

FIG. 4 is an elevational view similar to FIG. 3 of a further embodiment of the invention for the operational mode indicated in FIG. 3A, although FIG. 4 is a mirror-inverted representation as compared to FIG. 3. According to this embodiment, the contact pressure cylinders 5 as well as the pivotal cylinders 6 are guided in mutual dependence by a common control means 11 via the control lines 11*a* and 11*b*. This will be explained in detail in the following.

The operational mode of the set of guide rolls is as follows:

For introducing the material band B into the set of guide rolls, the upper roll 2 with its horizontal axis M can be placed by means of the contact pressure cylinders 5 in its topmost position shown by axis position M″ in FIG. 4 (the topmost position of the articulation point 5*a*″ of the contact pressure cylinders 5 on the superposed frame 3 is also indicated).

During the entrance stage of band B, roll 2 (position 2′ and M′) is placed above roll 1 and drives the band B guided in respect of band center and band edges (guidance and control of the band is achieved in a manner known per se by pivoting the pivotal frame 7 in regard of the basic frame 8 due to the action of the control cylinder 9). During this entrance stage (entrance of the material band B), the rolls 1 and 2, pivoted into a position one above the other by the pivotal cylinders 6 and the double-armed levers 4 and the superposed frame 3, thus cooperate as a driver. In this position, the rolls 1 and 2 are driven and pressed against one another by the contact pressure cylinders 5.

During the transition to the operational stage or main operation, the upper roll is placed in the position of band guidance by pivoting the levers 4 and the frame 3 by means of the contact pressure cylinders 5 and the pivotal cylinders 6 (in particular the pivotal cylinders 6), i.e. the roll 2 is placed into the space between the lower rolls 1 and 1*a*, as shown in full lines in FIG. 3 and 4.

The penetration depth of the upper roll 2 into the alignment of the driven roll 1 and the undriven roll 1*a* is determined by the defined adjustment of the contact pressure cylinders 5 (shown in broken lines in FIG. 3 by the roll position 2‴ of greater penetration depth).

As a result of the cooperation of the contact pressure cylinders 5 and the pivotal cylinders 6 established by the common control means 11 shown in FIG. 4, the roll 2—as shown schematically in FIG. 3A —can be placed during the transition from driver position to control position and vice versa along a predeterminable motion line or track. FIG. 3A shows the driver position by position 2′ and M′ of roll 2 and the contact pressure arrows pointing against one another; at the transition of roll 2 to the main operational or control position, the contact line P between the rolls 1 and 2 along the circumference of roll 1 can be advanced up to the intermediate position $2^{IV}$ and $M^{IV}$ shown in FIG. 3A, whereupon roll 2 is moved from its position $2^{IV}$ along arrow F immediately into the preselected main operational and control position. Band B is thus constantly kept under control.

In the exiting stage, the upper roll 2 is moved back from the main operational and control position into the driver position 2′ and M′, optionally again along a preselectable motion line, the rolls 1 and 2, in particular the upper roll 2, operating as braking rolls (negative driver) during this operational stage.

I claim:

1. Guide roll apparatus for guiding, positioning and controlling the motion of metal strips advanced in a direction through said apparatus comprising (1) a base frame having a supporting surface extending in a horizontal plane, (2) a pivotable frame supported by sliding means upon said supporting surface of said base frame and rotatable with respect to said supporting surface of said base frame about a vertical axis, (3) control cylinder means connected to said base frame and said pivotable frame and adapted to provide strip guiding motion transversely to the advancing direction of a strip by rotatably positioning said pivotable frame relative to said base frame, (4) two spatially arranged lower rolls having parallel horizontal axes and being rotably supported by said pivotable frame, (5) a third, upper roll having a corresponding parallel horizontal axis and being rotably supported in a frame that is superposed to said pivotable frame by means of articulated uprights at one end thereof and a pivotable pressure cylinder at the other end thereof, the uprights being double-armed levers pivotable about an horizontal axis to said pivotable frame, said pivotable cylinder also being articulated to said pivotable frame, and (6) a pivoting cylinder articulated at one end thereof to the lower end of each of the double-armed levers such that said pivotable axes of said double-armed levers are intermediate the lower ends about which the pivoting cylinders are articulated to the double-armed levers and ends about which the double-armed levers are articulated to the pivotable frame, the other end of each pivoting cylinder being articulated to the pivotable frame, said pivotable pressure cylinder and pivoting cylinders being operable to move said upper roll from a position between said lower rolls to a position directly above one of said lower rolls.

2. The guide roll apparatus of claim 1, wherein the third upper roll supported on the superposed frame is adapted to as to be guided over the frontmost lower roll in driving and braking capacities by means of the pivotable pressure cylinder and pivoting cylinder acting upon the double-armed levers and the superposed frame.

3. The guide roll apparatus of claim 2, wherein the pressure cylinder and the control cylinder means are controlled by a common control means whereby the upper roll is passed in a preselected line of motion during alternation to or from the driving or braking position to the guiding operation.

* * * * *

UNITED STATES PATENT OFFICE

CERTIFICATE OF CORRECTION

Patent No. 4,995,541 Dated February 26, 1991

Inventor(s) Gottfried Seidinger

It is certified that error appears in the above-identified patent and that said Letters Patent is hereby corrected as shown below:

Col. 5, claim 1, line 3, "rotably" should read --rotatably--

Col. 5, claim 1, line 6, "rotably" should read --rotatably--

Col. 6, claim 2, line 7, "to" first occurance should read --so--

Signed and Sealed this

Twenty-eighth Day of July, 1992

*Attest:*

DOUGLAS B. COMER

*Attesting Officer*

*Acting Commissioner of Patents and Trademarks*